US008067056B2

(12) United States Patent
Kastner et al.

(10) Patent No.: US 8,067,056 B2
(45) Date of Patent: Nov. 29, 2011

(54) METHOD FOR PRODUCING TAMPER-PROOF IDENTIFICATION ELEMENTS

(75) Inventors: Friedrich Kastner, Grieskirchen (AT); Martin Bergsmann, Liniz (AT); Harald Walter, Birmensdorf (CH); Georg Bauer, Fraham (AT); Ralph Domnick, Lingen/Ems (DE)

(73) Assignees: Hueck Folien Ges .M.B.I.I., Baumgartenberg (AT); November AG, Erlangen (DE)

( * ) Notice: Subject to any disclaimer, the term of this patent is extended or adjusted under 35 U.S.C. 154(b) by 1532 days.

(21) Appl. No.: 10/523,825

(22) PCT Filed: Jul. 28, 2003

(86) PCT No.: PCT/EP03/08327

§ 371 (c)(1),
(2), (4) Date: Nov. 3, 2005

(87) PCT Pub. No.: WO2004/014663

PCT Pub. Date: Feb. 19, 2004

(65) Prior Publication Data

US 2006/0147640 A1 Jul. 6, 2006

(30) Foreign Application Priority Data

Aug. 6, 2002 (AT) ..... A 1191/2002

(51) Int. Cl.
*B05D 1/36* (2006.01)

(52) U.S. Cl. ..... 427/7; 427/180; 427/248.1; 427/402; 427/404; 427/407.1

(58) Field of Classification Search ..... 427/7, 180, 427/248.1, 402, 404, 407.1
See application file for complete search history.

(56) References Cited

U.S. PATENT DOCUMENTS

| | | | | |
|---|---|---|---|---|
| 4,856,857 | A | 8/1989 | Takeuchi et al. | |
| 5,286,286 | A * | 2/1994 | Winnik et al. | 106/31.15 |
| 2002/0123235 | A1 * | 9/2002 | Kraus et al. | 438/755 |
| 2004/0026917 | A1 * | 2/2004 | Bauer et al. | 283/67 |
| 2004/0101676 | A1 * | 5/2004 | Phillips et al. | 428/323 |
| 2005/0001038 | A1 * | 1/2005 | Walter et al. | 235/487 |

FOREIGN PATENT DOCUMENTS

| | | |
|---|---|---|
| JP | 10-100573 | 4/1998 |
| WO | 01 53113 | 7/2001 |
| WO | 02 18155 | 3/2002 |
| WO | 02 051646 | 7/2002 |
| WO | 03 016073 | 2/2003 |

* cited by examiner

*Primary Examiner* — Kirsten Jolley
(74) *Attorney, Agent, or Firm* — Wenderoth, Lind & Ponack, L.L.P.

(57) ABSTRACT

The invention relates to a method for producing tamper-proof identification elements, and to tamper-proof identification elements produced according to said method and consisting respectively of at least one layer (2) reflecting electromagnetic waves (3), a spacer layer, and a layer consisting of metallic clusters (4). According to said method, a partial or all-over layer reflecting electromagnetic waves is applied to a carrier substrate (1), followed by at least one partial and/or all-over polymer layer having a defined thickness (3), and a layer consisting of metallic clusters which is produced by means of a method using vacuum technology or from systems based on solvents is then applied to said spacer layer(s).

10 Claims, 4 Drawing Sheets

METHOD FOR PRODUCING TAMPER-PROOF IDENTIFICATION ELEMENTS

BACKGROUND OF THE INVENTION (1) Field of the Invention

The invention relates to a method for the production of antifalsification identification elements having a color tilting effect caused by metallic clusters separated from a mirror layer across a defined transparent layer.

(2) Description of Related Art

WO 02/18155 discloses a method for the antifalsification marking of objects, the object being provided with a marking comprised of a first layer reflecting electromagnetic waves, onto which an inert layer, transparent to electromagnetic waves, of defined thickness is applied, and this inert layer is succeeded by a third layer formed of metallic clusters.

Brief Summary of the Invention

The invention addresses the problem of providing a method for the production of antifalsification identification elements on flexible materials, the property of security against falsification being provided by a visible color change at different viewing angles (tilting effect), which is also to be machine-readable. In the spectrum read out by machine the production method is to be coded unambiguously.

The subject matter of the invention is therefore a method for the production of antifalsification identification elements, each comprised of at least one layer reflecting electromagnetic waves, a spacer layer and a layer formed of metallic clusters, wherein onto a carrier substrate a partial or all-over layer reflecting electromagnetic waves is applied, and subsequently one or several partial and/or all-over polymeric layers of defined thickness are applied, whereupon onto the spacer layer a layer, formed of metallic clusters, is applied which are produced by means of a method using vacuum technology or out of systems based on solvents.

Carrier substrates to be considered are preferably flexible films of synthetic materials, for example of PI, PP, MOPP, PE, PPS, PEEK, PEK, PEI, PSU, PAEK, LCP, PEN, PBT, PET, PET, PA, PC, COC, POM, ABS, PVC. The substrate films preferably have a thickness of 5-700 μm, preferably 8-200 μm, especially preferred 12-50 μm.

Further, metal foils, for example Al, Cu, Sn, Ni, Fe or special steel foils having a thickness of 5-200 μm, preferably 10 to 80 μm, especially preferred 20-50 μm can also serve as the carrier substrate. The foils can also be surface-treated, coated or laminated, for example with synthetic materials or they can be lacquered.

Further, as carrier substrates can also be utilized cellulose-free or cellulose-containing paper, thermally activatable paper or composites with paper, for example composites with synthetic materials having a weight per unit area of 20-500 $g/m^2$, preferably 40-200 $g/m^2$. Onto the carrier substrate is applied a layer reflecting electromagnetic waves. This layer can preferably be comprised of metals, such as for example aluminum, gold, chromium, silver, copper, tin, platinum, nickel and their alloys, for example nickel/chromium, copper/aluminum and the like.

The electromagnetic wave reflecting layer can be applied over the entire surface or only partially by known methods, such as spraying, vapor deposition, sputtering, printing (gravure, flexography, screen printing, digital printing), lacquer coating, roller spreading methods and the like.

A method utilizing a soluble color coating for the production of the partial metallization is especially suitable for a partial application. In this method in a first step a color coating soluble in a solvent is applied onto the carrier substrate, in a second step this layer is optionally treated by means of an inline plasma, corona or flame process, and, in a third step, a layer of the metal or metal alloy to be structured is applied, whereupon in a fourth step the color coating is removed by means of a solvent, optionally combined with mechanical action.

The soluble color coating can be all-over or partial, the application of the metal or of the metal alloy takes place over the entire surface or partially.

The color coating can be completed by any desired method, for example by gravure, flexography, screen printing, digital printing and the like. The color substance or the lacquer utilized is soluble in a solvent, preferably in water, however, a color substance soluble in any desired solvent, for example alcohol, esters and the like, can be also be employed. The color substance or the lacquer can be conventional compositions based on natural or synthetic macromolecules. The soluble color substance can be pigmented or nonpigmented. As pigments can be utilized all known pigments. Especially suitable are $TiO_2$, ZnS, kaolin and the like.

Subsequently, the imprinted carrier substrate is optionally treated by means of an inline plasma (low-pressure or atmospheric pressure plasma), corona or flame process. The surface is depurated of toning residues of the printing colors through a high-energy plasma, for example Ar or $Ar/O_2$ plasma.

The surface is simultaneously activated. In this step terminal polar groups are generated on the surface. Thereby the adhesion of metals and the like on the surface is improved.

Optionally, concurrent with the application of the plasma or corona or flame treatment or following it, a thin metal or metal oxide layer can be applied, for example by sputtering or vapor deposition, as an adhesion promoter. Especially suitable are Cr, Al, Ag, Ti, Cu, $TiO_2$, Si oxides or chromium oxides. In general this adhesion promoter layer has a thickness of 0.1 nm-5 nm, preferably 0.2 nm-2 nm, especially preferred 0.2 nm to 1 nm.

Thereby the adhesion of the metal or metal alloy layer applied partially or all-over and reflecting electromagnetic waves, is further improved.

However, a partial, electromagnetic wave reflecting layer can also be produced through conventional known etching methods.

The thickness of the electromagnetic wave reflecting layer is preferably approximately 10-50 nm, but greater or lesser layer thicknesses are also possible. If metal foils are utilized as the carrier substrate, the carrier substrate can just by itself already form the layer reflecting electromagnetic waves.

The reflection of this layer for electromagnetic waves, in particular as a function of the thickness of the layer or of the metal foil utilized, is preferably 10-100%.

The polymeric layer(s) following thereupon can also be applied all-over or only partially. The polymeric layers comprise, for example, color or lacquer systems based on nitrocellulose, epoxy, polyester, colophonium, acrylate, alkyd, melamine, PVA, PVC, isocyanate or urethane systems.

This polymeric layer serves substantially as a transparent spacer layer, but, depending on its composition, can be absorbing in a certain spectral range. This property of absorption can optionally also be enhanced by adding a suitable chromophore. A suitable spectral range can be selected through the selection of different chromophores. Thereby, in addition to the tilting effect, the polymeric layer can additionally also be made machine-readable. For example, in the blue spectral range (in the proximity of approximately 400 nm) a yellow AZO coloring agent can also be utilized, for example anilide, rodural or eosin. The coloring agent moreover changes the spectrum of the marking in a characteristic manner.

As a function of the quality of the adhesion on the substrate web or an optionally subjacent layer, this polymeric layer can exhibit decrosslinking effects, which lead to characteristic macroscopic lateral structuring. This structuring can be specifically changed for example through modification of the surface energy of the layers, for example through plasma treatment, corona treatment, electron or ion beam treatment or through laser modification. It is further possible to apply an adhesion promoting layer with locally different surface energy.

The polymeric layer has a defined thickness, preferably 10 nm to 3 μm, especially preferred 100-1000 nm. If several polymeric layers are applied, these can each have a different thickness.

The polymeric layer can be applied employing any desired coating method such as, for example, spreading or brushing, coating, pouring, spraying, printing (screen printing, gravure, flexography or digital printing methods) or roller coating methods.

The polymeric layer is preferably applied with a method which permits the application of highly homogeneous layer thicknesses over large areas. Homogeneity of the layer thickness is required in order to ensure a uniform color appearance in the finished product. The tolerances are preferably no more than ±5%, preferably ≦±2%.

Especially suitable is a printing method in which the coloring substance or the lacquer is applied from a temperature-regulated coating pan with a dipping roller and a transfer cylinder onto the printing cylinder, wherein substantially only the depressions of the printing cylinder are filled with the coloring or the coating substance. Excess coloring or coating substance is removed by means of a blade and optionally further wiped off by means of a blowing strip.

Onto the polymeric layer a layer formed of metallic clusters is subsequently applied. The metallic clusters can comprise for example aluminum, gold, palladium, platinum, chromium, silver, copper, nickel and the like or their alloys, such as for example Au/Pd or Cr/Ni. This cluster layer can be applied by sputtering (for example ion beam or magnetron) or vapor deposition (electron beam) out of a solution or by adsorption.

In the production of the cluster layer in vacuum processes the growth of the clusters, and therewith their form as well as the optical properties, can advantageously be affected by setting the surface energy or the roughness of the subjacent layer. This causes a characteristic change of the spectra. This can take place, for example, through thermal treatment in the coating process or by preheating the substrate. For example the form, and therewith also the optical properties of the clusters, can be affected by setting the surface energy or of the condensation coefficients of the metal on the subjacent layer.

These parameters can take place [sic] for example by treatment of the surface with oxidizing fluids, for example with sodium hypochlorite or in a PVD or CVD process.

The cluster layer can preferably be applied by means of sputtering. The properties of the layer, in particular thickness and structure, can therein be set especially through the power density, the quantity and composition of the gas utilized, the temperature of the substrate and the web [transport] rate.

When applying out of a solution by means of methods utilizing wet chemistry, in a first step the clusters are produced in solution, the clusters are subsequently derivatized, concentrated and applied directly onto the polymeric surface.

For the application by means of methods of printing technology, after the concentration of the clusters small quantities of an inert polymer, for example PVA, polymethylmethacrylate, nitrocellulose, polyester or urethane systems, are added. The mixture can subsequently be applied onto the polymeric layer by means of a printing method, for example screen printing, flexography or preferably gravure.

The thickness of the cluster layer is preferably 2-20 nm, especially preferred 3-10 nm.

Thereover a protective layer can additionally be applied with methods of vacuum technology or printing technology.

In a preferred embodiment the polymeric layer is specifically structured by modification of the surface energy. Due to the color effect, the structures in this case through the subsequently applied cluster layer appear extremely rich in contrasts, whereby they become readily visually recognizable. Through such structuring therefore an additional characteristic antifalsification feature is generated.

Through fingerprint algorithms this structuring can further be converted into unique codes, which subsequently are machine-readable.

Thereby a structuring can be assigned to a defined numerical value, with markings with the same manufacturing parameters, i.e. with identical color effect, becoming individualizable.

For use, in particular as a security feature, the individual layer combinations can also be applied onto separate substrates. For example, the layer reflecting electromagnetic waves and the polymeric spacer layer can be applied onto a first substrate, which can be applied for example on a valuable and important documents or can be introduced into this document. Onto a further substrate the cluster layer can subsequently be applied, which optionally is provided with an adhesive layer. By joining the two coated substrates, the characteristic color effect subsequently becomes apparent according to the lock-and-key principle.

The carrier substrate itself can already be comprised of one or several functional and/or decorative layers. The most diverse compositions can be utilized as such color or lacquer layers. The composition of the individual layers can vary in particular according to their tasks, depending on whether or not the individual layers serve exclusively for decorative purposes or are intended to be a functional layer or whether the layer is intended to be a decorative as well as also a functional layer.

The layers to be printed can be pigmented or nonpigmented. As pigments all known pigments can be employed, such as for example titanium dioxide, zinc sulfide, kaolin, ATO, FTO, ITO, aluminum, chromium and silicon oxides as well as also colored pigments. Solvent-containing lacquer systems as well as systems without solvents are utilizable.

As binding agents can be considered several natural or synthetic binding agents.

The functional layers can have, for example, certain electrical, magnetic, specific chemical, physical and also optical properties.

In order to set electrical properties, for example conductivity, graphite, carbon black, conductive organic or inorganic polymers, metal pigments (for example copper, aluminum, silver, gold, iron, chromium, lead and the like) can be added, by way of example. Metal alloys such as copper-zinc or copper-aluminum or their sulfides or oxides or also amorphous or crystalline ceramic pigments such as ITO and the like. Furthermore also doped or nondoped semiconductors, such as for example silicon, germanium or ionic conductors, such as amorphous or crystalline metal oxides or metal sulfides, can be utilized as additives. Further, to set the electrical properties of the layer, polar or partially polar compounds, such as tensides, or nonpolar compounds, such as silicone additives or hygroscopic or nonhygroscopic salts can be utilized or added.

For setting the magnetic properties, paramagnetic, diamagnetic and also ferromagnetic substances such as iron, nickel and cobalt or their compounds or salts (for example oxides or sulfides) can be utilized.

The optical properties of the layer can be affected by visible coloring substances or pigments, luminescent coloring substances or pigments, which fluoresce or phosphoresce in the visible range, the UV range or in the IR range, effect pigments, such as liquid crystals, pearlescent pigments, bronzes and/or heat-sensitive colors or pigments. These can be employed in all conceivable combinations. In addition, phosphorescent pigments alone or in combination with other color substances and/or pigments can be utilized.

Several different properties can also be combined by adding different additives from the list above. For example, it is possible to use dyed and/or conductive magnetic pigments. All of the listed conductive additives can be employed. Specifically for dying magnetic pigments all known soluble and nonsoluble color substances or pigments can be utilized. For example, through the addition of metals a brown magnetic color can be adjusted to have a metallic, for example silvery, color tone.

Moreover, insulation layers, for example, can be applied. Suitable insulators are, for example, organic substances and their derivatives and compounds, for example color and lacquer systems, for example epoxy, polyester, colophonium, acrylate, alkyd, melamine, PVA, PVC, isocyanate or urethane systems, which can be radiation-curing, for example by thermal or UV radiation.

These layers can be applied with known methods, for example by vapor deposition, sputtering, printing (for example gravure, flexography, screen and digital printing and the like), spraying, electroplating, roller coating methods and the like. The thickness of the functional layer is 0.001 to 50 μm, preferably 0.1 to 20 μm.

By repeating one or more times one or several of the described method steps, multilayered superstructures can be produced, whose layers, applied one above the other, differ in their properties. By combining different properties of the individual layers, for example layers with different conductivity, magnetizability, optical properties, absorption behavior and the like, it is possible to produce superstructures for example for security elements with several precise authenticity features.

The layers can already be provided on the substrate or be applied on it in each instance over the entire surface or only locally.

The method steps can be repeated as often as desired, and in the case of all-over application of a functional layer, for example, the color coating can optionally be omitted.

However, for example in known direct metallization methods or in metallization methods with etching partial metal layers or in known in known multicolor printing methods, further layers can be applied.

The coated film or foil produced in this manner can optionally also be additionally protected with a protective lacquer layer or, for example, be further improved by lamination or the like.

The product can optionally be applied with a sealable adhesive agent, for example a hot-setting sealing adhesive or a cold-setting sealing adhesive, onto the corresponding carrier material, or, for example, can be embedded through conventional methods in the paper during the paper making for antifalsification papers.

In order to increase the security against falsification, these sealing adhesives can be equipped with visible features, with features visible under UV light, or fluorescent or phosphorescent or those absorbing laser and IR radiation. These features can also be in the form of patterns or signs or symbols or they can exhibit color effects, and, in principle, any desired number of colors, preferably 1 to 10 colors or color mixtures, are possible for use.

After coating on one side, the carrier substrate can be removed after the application or remain on the product. The carrier foil can optionally be specially equipped on the non-coated side, for example be made scratch-resistant, antistatic or the like. The same applies to any possible lacquer layer on the carrier substrate.

The layer structure can be further adjusted to be transferable or nontransferable, optionally be provided with a transfer lacquer layer, which optionally can have a diffraction structure, for example a hologram structure.

The structure according to the invention can also be applied inversely on the carrier material, wherein onto a carrier substrate a layer formed of metallic clusters is applied, which is produced by means of methods of vacuum technology or out of solvent-based systems and subsequently one or several partial and/or all-over polymeric layers of defined thickness are applied, and thereupon a partial or all-over layer reflecting electromagnetic waves is applied onto the spacer layer.

FIGS. 1 to 6 depict examples of antifalsification features. Therein indicates 1 the carrier substrate, 2 the first layer reflecting electromagnetic waves, 3 the transparent layer, 4 the layer built of metallic clusters, 5 an optically transparent substrate, and 6 an adhesive or laminated layer.

DETAILED DESCRIPTION OF THE INVENTION

In the markings shown in FIG. 1 to 5, a first layer reflecting electromagnetic waves is denoted by (2). This can be a thin layer comprised of, for example, aluminum. However, the first layer (2) can also be a layer formed of metallic clusters, which is applied onto a carrier (1). The carrier (1) can be a carrier substrate to be marked. The inert spacer layer is denoted by (3). The metallic clusters (4) are usefully produced for example of copper. The adhesive or lamination layer provided for further processing of the antifalsification marked carrier substrate is denoted by (6) in FIG. 3 to 5. The change of the reflected light generating the characteristic color spectrum, in comparison to the incident light, is visualized in these two figures by means of the gray scale pattern in an arrow.

Figure 1:
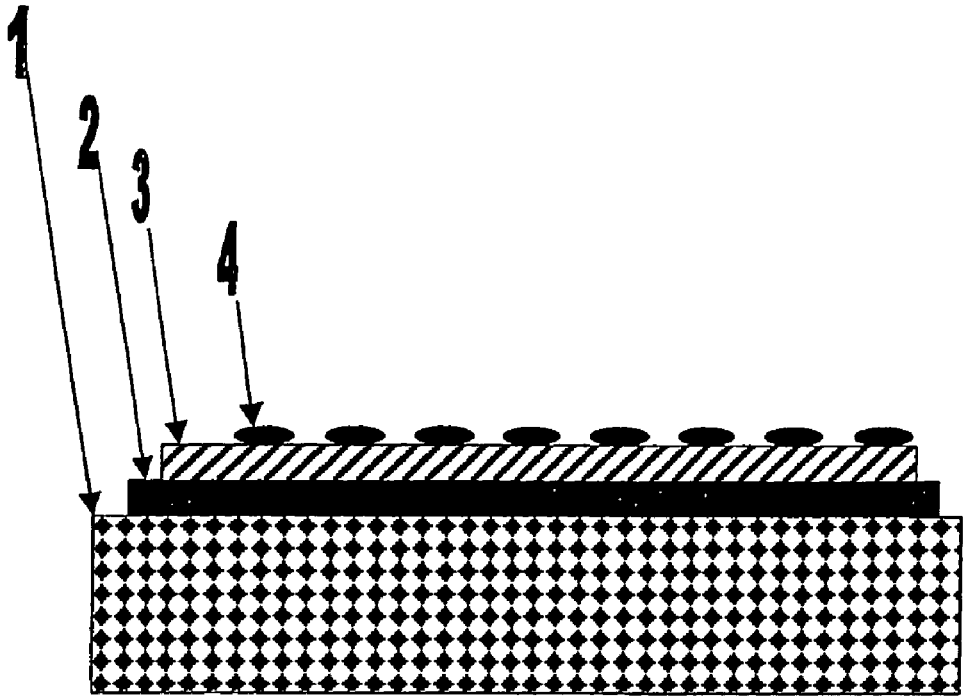
FIG. 1 shows a schematic cross sectional view of a first permanently visible marking on a carrier substrate, FIG. 2 a schematic cross sectional view of a not permanently visible first marking on a carrier substrate as well as a second carrier substrate suitable for proof or for visualization, FIG. 3 a schematic cross sectional view of a permanently visible first laminatable or adhesible marking, FIG. 4 a schematic cross sectional view of a further permanently visible second laminatable or adhesible marking, FIG. 5 a schematic cross sectional view of a not permanently visible first laminatable or adhesible marking as well as a second carrier substrate suitable for proof or for visualization, FIG. 6 a falsification-proof marked carrier substrate, coated in continuous large-scale process, partially wound up on rolls.
Figure 3:
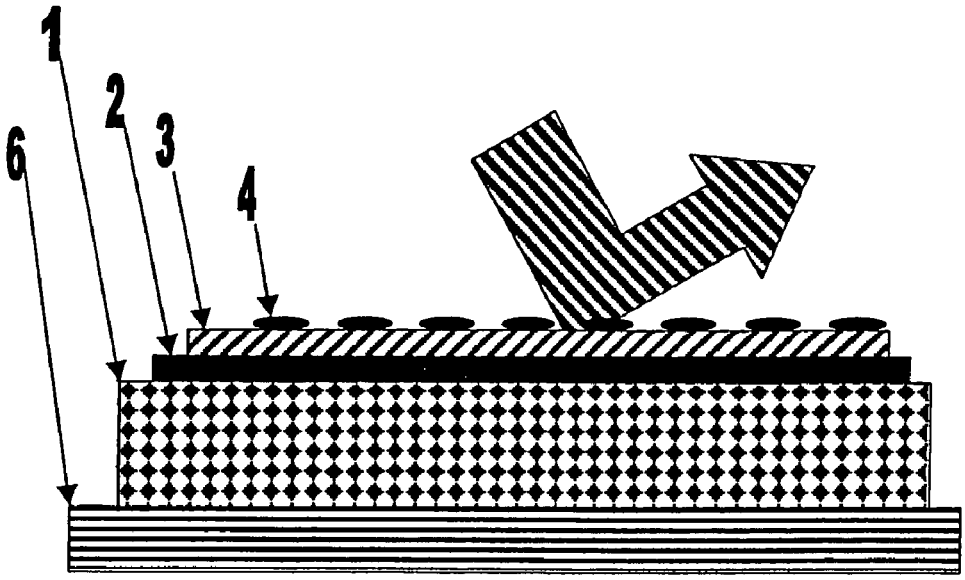

In the markings shown in FIGS. 1 and 3 a third layer (4) produced of metallic clusters is applied onto the second layer (3). The second layer (3) is applied onto a mirror layer (2). Further, the mirror layer is applied in FIGS. 1 and 3 onto a carrier substrate (1).

Figure 4:
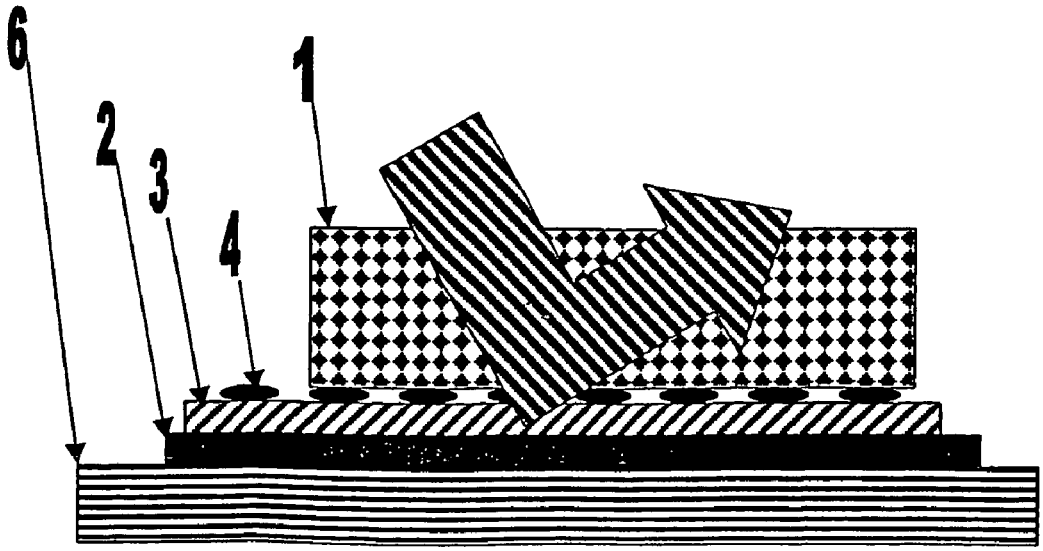

In FIG. 4 onto a carrier substrate (1), first, the third layer (4) formed of metallic clusters, subsequently the second layer (3), subsequently the mirror layer (2) and lastly the adhesion or lamination layer (6) is applied.

Figure 2:
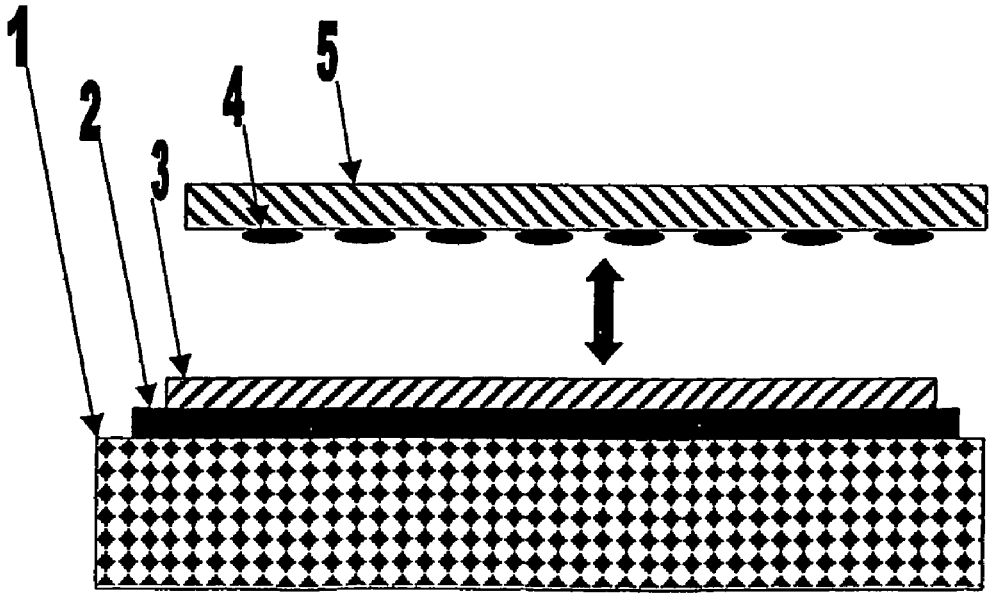
Figure 5:
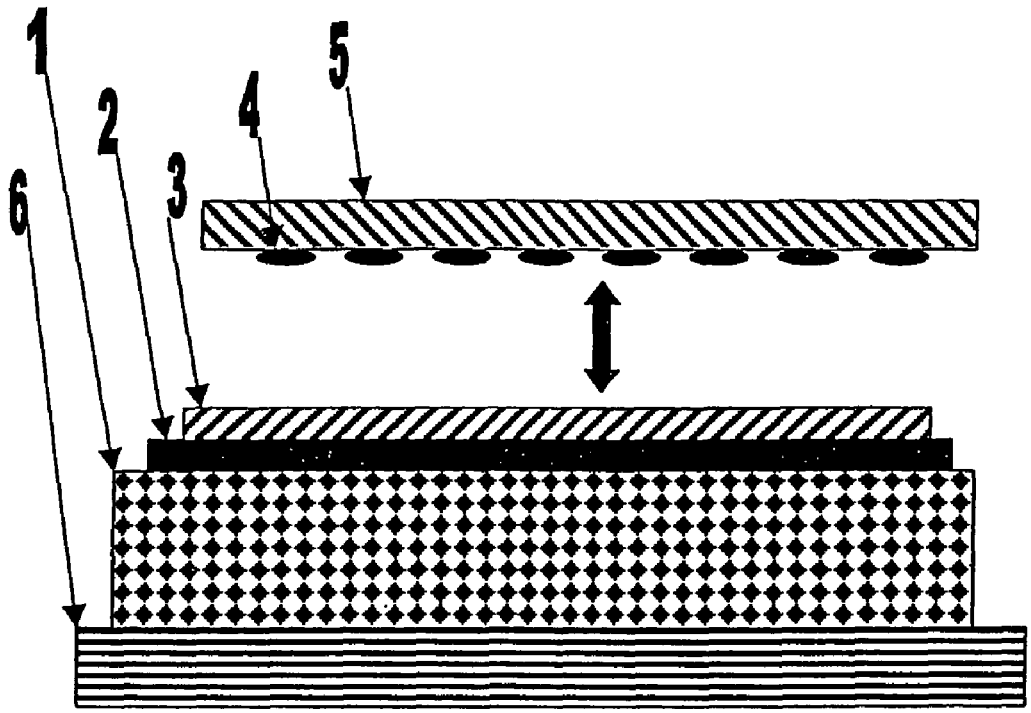
Figure 6:
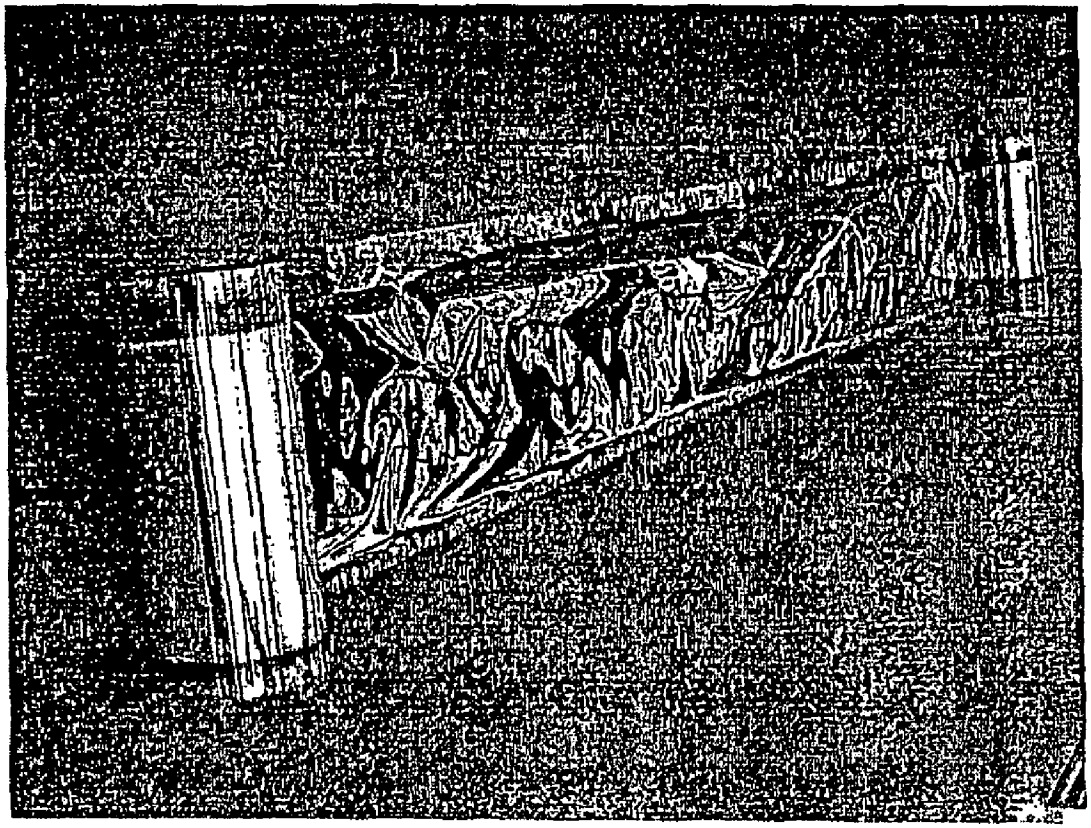

In the case of the markings shown in FIGS. 2 and 5 only the second layer (3) developed to be optically transparent is applied on the first electromagnetically reflecting layer (2) and the latter is applied on a carrier substrate (1). The marking is initially not visible. The markings are only visible when they are brought into contact with a substrate (5) on whose surface the third layer (4) formed of metallic clusters is applied. A color effect is again generated in this case, which can be observed through the substrate (5). The carrier substrate (5) is usefully produced of a transparent material, for example of a synthetic material such as polyethylene terephthalate, polycarbonate, polyurethane, polyethylene, polypropylene, polyacrylate, polyvinylchloride, or polyepoxide.

The function of the marking is as follows:

When light from a light source, such as an incandescent bulb, a laser, a fluorescent tube, a halogen lamp, in particular a xenon lamp, is incident on one of the markings shown in FIGS. 1, 3 and 4, this light is reflected on the first layer (1). Through the interaction of the reflected light with the third layer (4) formed of the metallic clusters, a portion of the incident light is absorbed. The reflected light has a characteristic spectrum dependent on several parameters, such as for example the optical constants of the layer structure. The marking appears colored. The coloration serves as antifalsification proof of authenticity of the marking. The color impression obtained in this way is a function of the angle and can be identified with the naked eye as well as also with a reading device, preferably a spectrophotometer, operating in reflection mode. Such a photometer can, for example, acquire the coloration of the surfaces from two different angles. This occurs either by means of a detector thereby that two light sources are utilized, which are correspondingly switched on and the detector is correspondingly tilted, or thereby that two photometers measure from two different angles the sample illuminated from the two corresponding angles.

With respect to the parameters to be maintained for the generation of the interactions, reference is made to U.S. Pat. No. 5,611,998, WO 98/48275 as well as WO 99/47702 and WO 02/18155, the disclosed content of which is herewith incorporated.

The coated carrier materials produced according to the invention can be employed as antifalsification features in data media, valuable documents, labels, tags, seals, in packagings, textiles and the like.

EXAMPLES

Example 1

Production of the cluster layer by means of wet chemical methods:

a) Synthesis of 14 nm gold clusters 100 ml distilled water are heated to boiling in a 250 ml flask. While stirring vigorously, first 4 ml of 1% of trisodium citrate in distilled water and subsequently 1 ml of 1% tetrachloroauric (III) acid in distilled water are added. Within 5 minutes the color of the reaction mixture changes from nearly colorless to dark purple to cherry red. Heating is subsequently terminated while stirring the mixture continues for approximately 10 minutes. Analysis of the resulting sol via transmission electron microscope shows spherical particles with a mean diameter of 14 nm. The size distribution of the cluster is narrow (cv<20%). The wavelength maximum of the optical absorption is at 518 nm.

b) Derivatization of the gold clusters: To 100 ml of gold sol according to the above synthesis are added while stirring vigorously 1 ml of a 1% solution of BSA (Bovine Serum Albumin) in distilled water. The color of the solution changes minimally from cherry red to a darker red. The maximum of the optical absorption is retained. Increased absorption is observed at wavelengths above 550 nm. Under the transmission electron microscope defined spacings between the particles can be observed.

c) Binding the gold clusters to a surface of nitrocellulose: To the sol (nearly pH neutral, hardly salt) is added a buffer solution of 5 ml of a 1M sodium carbonate solution (pH 9.6). Only the adequately protected clusters remain in solution and do not precipitate. The sol can be concentrated by centrifuging or it binds directly after the application to the surface coated with nitrocellulose. With suitable selection of the nitrocellulose layer thickness, a strong surface coloration develops after the excess water is removed.

Example 2

Production of the cluster layer by means of methods of printing technology After concentration by a factor of 10, to the sol are added small quantities (for example 5%) of a neutral polymer (for example PVA). Thereby printing with conventional gravure cylinders becomes possible. The colloids dry randomly oriented with the polymer into a very thin layer. Characteristic colors as in Example 1*c*) are observed.

Example 3

Production of the cluster layer by means of a method of vacuum technology Under high-vacuum conditions (base pressure $p<1\times10^{-3}$ mbar) a cluster layer having a thickness of 4 nm is sputtered onto a web-form carrier substrate, which had already been provided with a mirror layer and a nitrocellulose layer as the transparent spacer layer.

The sputtering takes place by means of a magnetron plasma source at a power of 20 W/cm$^2$ at 25° C. using Ar at a partial pressure of $5\times10^{-3}$ mbar as the process gas. The [transport] rate of the web is 0.5 m/s. Under these conditions the Cu[1] layer exhibits pronounced island growth. The islands with a mean diameter of a few nm correspond to the clusters formed in the wet chemical method.

The original does indeed say Cu even though the examples describe the preparation of Au clusters Other characteristic color spectra are clearly observed.

The invention claimed is:

1. A method for the production of an antifalsification identification element including at least one layer reflecting electromagnetic waves, one spacer layer and one layer formed of metallic clusters, the method comprising:

applying a partial layer or an all-over layer which reflects electromagnetic waves onto a first carrier substrate;

after said applying the layer which reflects electromagnetic waves, applying at least one partial polymeric layer and/or all-over polymeric layer of defined thickness onto the first carrier substrate to form a spacer layer;

modifying the spacer layer by a process selected from a group consisting of a PVD process, a CVD process, and treatment with oxidizing fluids; and applying a layer formed of metallic clusters onto a second carrier substrate the layer formed of metallic clusters being produced by a method of vacuum technology or by solvent-based- systems, wherein after said applying the layer which reflects electromagnetic waves and said applying the polymeric layer, and after said applying the layer formed of metallic clusters onto the second carrier substrate, the first carrier substrate and the second carrier substrate are connected such that the layer formed of metallic clusters is applied to the spacer layer to form the antifalsification identification element.

2. The method of claim 1, wherein a protective layer is applied onto the layer formed of metallic clusters.

3. The method of claim 1, wherein the spacer layer is structured through decrosslinking effects.

4. The method of claim 3, characterized in that the decrosslinking structures of the spacer layer are converted into unique codes by means of fingerprint algorithms.

5. The method of claim 1, wherein the spacer layer is modified by treatment with sodium hypochlorite.

6. The method of claim 1, wherein the spacer layer comprises a chromophore.

7. The method of claim 1, wherein the layer formed of metallic clusters is deposited by sputtering or vapor deposition.

8. The method of claim 1, wherein said modifying the spacer layer is performed by a PVD process.

9. The method of claim 1, wherein said modifying the spacer layer is performed by a CVD process.

10. The method of claim 1, wherein said modifying the spacer layer is performed by treatment with oxidizing fluids.

* * * * *